US009662260B2

(12) United States Patent
Bervian

(10) Patent No.: US 9,662,260 B2
(45) Date of Patent: May 30, 2017

(54) DEVICE FOR PASSIVE BODY MOBILIZATION

(71) Applicant: Paulo Sergio Bervian, Doungguan (CN)

(72) Inventor: Paulo Sergio Bervian, Doungguan (CN)

( * ) Notice: Subject to any disclaimer, the term of this patent is extended or adjusted under 35 U.S.C. 154(b) by 444 days.

(21) Appl. No.: 14/087,622

(22) Filed: Nov. 22, 2013

(65) Prior Publication Data

US 2015/0148715 A1 May 28, 2015

(51) Int. Cl.
*A61H 1/02* (2006.01)
*A61G 13/08* (2006.01)
*A61G 13/00* (2006.01)

(52) U.S. Cl.
CPC ..... *A61H 1/0292* (2013.01); *A61G 13/009* (2013.01); *A61H 1/0244* (2013.01); *A61H 2201/1215* (2013.01); *A61H 2201/1642* (2013.01); *A61H 2201/1664* (2013.01); *A61H 2201/5007* (2013.01); *A61H 2201/5043* (2013.01); *A61H 2203/0456* (2013.01); *A61H 2205/088* (2013.01)

(58) Field of Classification Search
CPC ..... A61H 1/005; A61H 1/02; A61H 1/0207; A61H 1/0222; A61H 1/0244; A61H 1/0251; A61H 1/0259; A61H 1/0292; A61H 2203/0456; A61H 2205/088; A61G 7/015; A61G 13/08; A61G 13/009
See application file for complete search history.

(56) References Cited

U.S. PATENT DOCUMENTS 1,602,196 A * 10/1926 Iverson ..... A61H 1/02 366/216
5,860,899 A * 1/1999 Rassman ..... A61H 1/0222 482/131
6,428,497 B1 * 8/2002 Crouch ..... A61F 5/04 128/845
6,971,997 B1 * 12/2005 Ryan ..... A61F 5/04 5/614
7,201,729 B2 * 4/2007 Emsky ..... A61H 1/0218 128/845
2003/0135137 A1 * 7/2003 Splane, Jr. ..... A61G 13/009 601/24
2006/0058717 A1 * 3/2006 Hui ..... A61H 9/0078 601/152
2013/0261510 A1 * 10/2013 Anderson ..... A61H 1/02 601/5

* cited by examiner

*Primary Examiner* — Valerie L Woodward
(74) *Attorney, Agent, or Firm* — Hauptman Ham, LLP

(57) ABSTRACT

A passive body mobilization device having a base (10) having an engine (1) controlled by a Programmable Logic Controller (PLC) (100), said base (10) having a moveable platform in the horizontal plane (20) positioned on linear guides (11) arranged on the base (10) moved by a frequency inverter and arranged between a first extreme area (30) for positioning the head, chest and abdomen and a second area at the opposite end (40) for positioning the lower limbs, allowing the hip height to be changed in relation to the rest of the body, providing stages that allow regions of the spine to be worked specifically, eliminating the paralysis of peripheral nerves, bringing blood pressure back to normal by stimulating the sympathetic nerve and peristalsis.

1 Claim, 2 Drawing Sheets

DEVICE FOR PASSIVE BODY MOBILIZATION

FIELD OF THE INVENTION

The present invention concerns a passive body mobilization device. More specifically, it comprises a device that allows the body to be stretched out and the body's axis to be moved, inducing the lateral flexion and extension of the abdomen.

BACKGROUND OF THE INVENTION

Humans have approximately 639 muscles. Each muscle has its motor nerve, which is divided into several fibers to be able to control all muscle cells, through the motor endplate.

Muscles are active organs for moving. They are provided with the ability of contracting and relaxing and, thus, they transmit their motions to the bones to which they are attached, which form the passive system of the locomotor apparatus.

The body's movement, with the displacement of the body's axis, offers stimuli inducing the functions related to the middle and low burners of the human body, according to Chinese Traditional Medicine, through induced mobility and delivery conditioning to whom is subjected to this device.

SUMMARY

The invention provides a device for passive body mobilization that produces lateral flexion and extension movements simultaneously (crawling simulation) of the thoracicolumbar region.

The invention provides a device for passive body mobilization that provides as outcome weight loss and toning of the waist region (abdominal and lumbar muscles).

The invention provides a device for passive body mobilization that provides relaxation of lumbar tensions, as it is a passive activity, without impact and without joint compression.

The invention provides a device for passive body mobilization that provides improvement of organic functions related to the region being worked and activates the circulation of the small bowel and enhances the function of nutrient absorption, facilitates the peristaltic movement of the large bowel, livens the intestinal flora, helps in the process against constipation and hemorrhoids, activates the circulation of the genital region.

The invention provides a device for passive body mobilization that allows exercises to be performed without physical effort, resistance and requirement of psychomotor control.

The invention provides a device for passive body mobilization that provides a greater reason for preserving the articular bodies and the results of their impact as movements are performed horizontally.

DETAILED DESCRIPTION OF THE INVENTION

Figure 1:
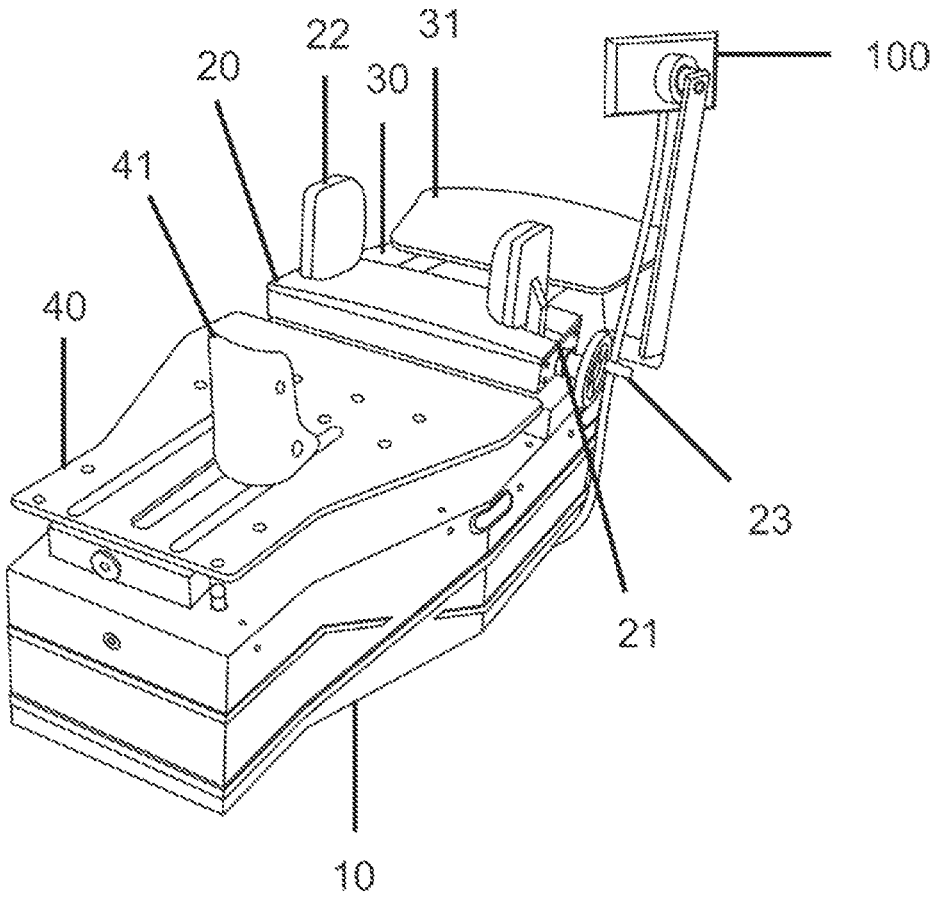
FIG. 1 shows a perspective view of the device.
Figure 2:
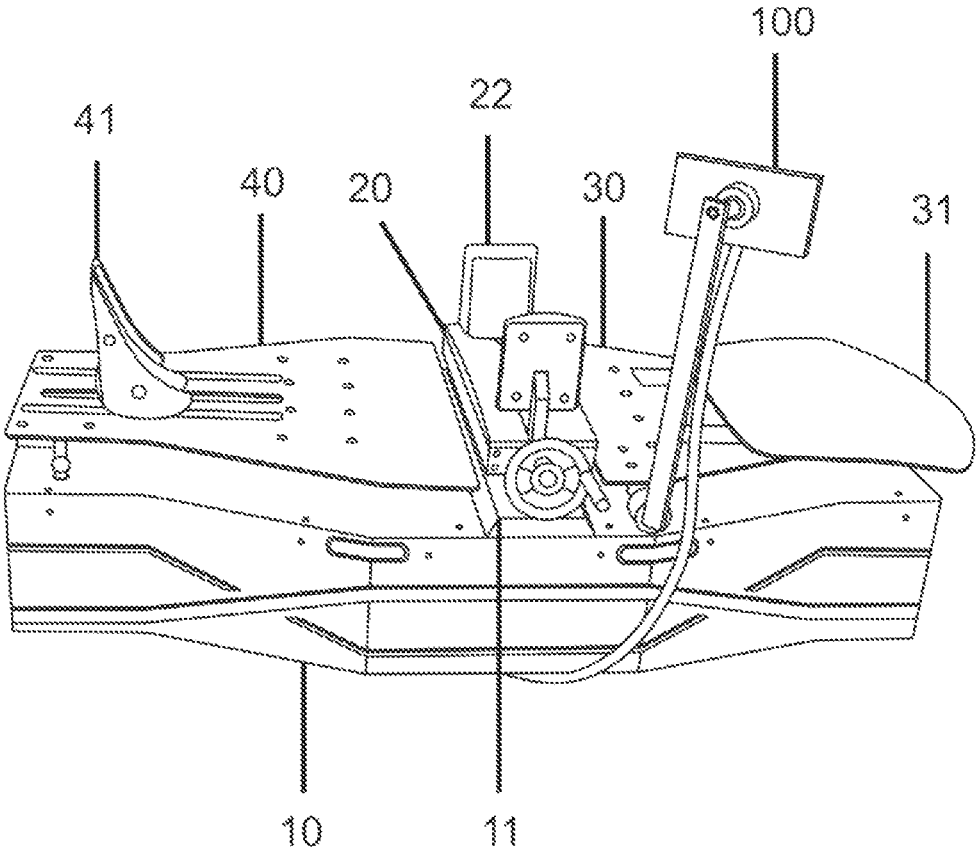
FIG. 2 shows a side view.

The device for passive body mobilization, object of the present invention, comprises a base (10) that has on the upper face a bipartite structure for placing an individual lying down, said device presents a motor unit controlled by a Programmable Logic Controller (PLC) (100).

The bipartite structure comprises an oblong-shaped body that has a region of discontinuity placed in a transverse central area where a movable platform (20) is disposed for placing the user's hip, an area on one of the ends (30) for placing the head, chest and abdomen and a second area on the opposite end (40) for placing the lower limbs.

The first area (30) and the second area (40) present a mechanism that allows for adjusting the height or the surface inclination of said areas (30 and (40), said mechanism that can include a manual adjustment as a lever or an automatic adjustment activated by the PLC.

The first area (30) preferably has a support (31) for the user's head, so as to avoid an involuntary motion.

The second area (40) preferably has a support (41) for fixing the user's feet, said support (41) that has means for adjusting the position in said second area (40).

The movable platform (20) comprises a structure placed in linear guides (11) disposed on the base (10), said movable platform (20) performs a movement on the horizontal plane between the sides of the base (10) when activated by a frequency inverter (not shown).

On the sides of the movable platform (20) guides (21) are placed which allow for adjusting the distance between the side plates (22) that immobilize the user's hip.

Optionally, the movable platform (20) has a means for adjusting height (23) so as to be level or unlevel to the first (30) and second areas (40).

The user preferably lays down on his back on the bipartite structure, so as to keep his hip supported on the movable platform (20), with the side plates (22) being adjusted to be near the user's body.

After having the head and feet placed on the respective supports (31) and (41), the device is activated on the PLC dashboard (100), for the movable platform (20) to move horizontally in previously set cycles in order to displace the body's axis.

The invention claimed is:

1. A passive mobilization device comprising a base presenting a moveable platform in a horizontal plane positioned on linear guides arranged on the base moved by a frequency inverter and arranged between a first end area for positioning a head, a chest and an abdomen of a user and a second area at an end opposite the first end for positioning lower limbs of the user, said first area and said second area configured for height adjustment and/or inclination adjustment relative the movable platform, said moveable platform comprising sides equipped with guides for adjustment of lateral plates to immobilize the user's hip, wherein said movable platform is movable in a transverse plane of the user's hip;

wherein said linear guides are configured to allow said movable platform to be movable in the transverse plane along a coronal plane of the user's hip; and wherein said movable platform is movable in the transverse plane along a sagittal plane of the user's hip so as to be level or unlevel with the first area or the second area.

* * * * *